US010633982B2

(12) United States Patent
Bang

(10) Patent No.: US 10,633,982 B2
(45) Date of Patent: Apr. 28, 2020

(54) TURBINE VANE HAVING IMPINGEMENT PLATE FOR GAS TURBINE AND GAS TURBINE INCLUDING THE SAME

(71) Applicant: DOOSAN HEAVY INDUSTRIES & CONSTRUCTION CO., LTD., Changwon-si, Gyeongsangnam-do (KR)

(72) Inventor: Myeong Hwan Bang, Busan (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 16 days.

(21) Appl. No.: 16/020,968

(22) Filed: Jun. 27, 2018

(65) Prior Publication Data

US 2019/0093486 A1 Mar. 28, 2019

(30) Foreign Application Priority Data

Sep. 22, 2017 (KR) ..... 10-2017-0122454

(51) Int. Cl.
*F01D 5/18* (2006.01)
*F01D 5/14* (2006.01)
*F01D 9/06* (2006.01)

(52) U.S. Cl.
CPC ..... *F01D 5/187* (2013.01); *F01D 5/147* (2013.01); *F01D 9/065* (2013.01); *F01D 5/188* (2013.01);
(Continued)

(58) Field of Classification Search
CPC . F01D 5/18; F01D 5/147; F01D 5/187; F01D 5/188; F01D 9/065; F05D 2240/12;
(Continued)

(56) References Cited

U.S. PATENT DOCUMENTS 5,207,556 A * 5/1993 Frederick ..... F01D 5/189 415/115
5,464,322 A * 11/1995 Cunha ..... F01D 5/187 415/115

(Continued)

FOREIGN PATENT DOCUMENTS

EP 3054113 A1 8/2016
EP 3165716 A1 * 5/2017 ..... F01D 5/18

(Continued)

OTHER PUBLICATIONS

An European Search Report dated Dec. 20, 2018 in connection with European Patent Application No. 18181307.2 which corresponds to the above-referenced U.S. application.
A Korean Office Action dated Sep. 3, 2018 in connection with Korean Patent Application No. 10-2017-0122454 which corresponds to the above-referenced U.S. application.

*Primary Examiner* — Dwayne J White
*Assistant Examiner* — Eric A Lange
(74) *Attorney, Agent, or Firm* — INVENSTONE Patent, LLC

(57) ABSTRACT

A gas turbine includes a housing; a rotor rotatably provided in the housing; a turbine blade to receive rotating force from combustion gas and rotate the rotor; a turbine vane to guide a flow of the combustion gas toward the turbine blade, the turbine vane having a turbine vane cooling passage for delivering cooling fluid to an inner wall of the turbine vane; and an impingement plate installed in the turbine vane cooling passage, the impingement plate having a plurality of injection holes through which the cooling fluid is injected onto the inner wall of the turbine vane, the injection holes formed at predetermined locations of the impingement plate, wherein the injection holes are formed differently depending on locations of the injection holes. A temperature gradient or thermal stress may be prevented from occurring in the
(Continued)

turbine vane that is cooled by cooling fluid ejected from the impingement plate.

17 Claims, 5 Drawing Sheets

(52) U.S. Cl.
CPC ..... *F01D 5/189* (2013.01); *F05D 2240/12* (2013.01); *F05D 2240/301* (2013.01); *F05D 2260/201* (2013.01); *F05D 2260/202* (2013.01)

(58) Field of Classification Search
CPC ..... F05D 2240/201; F05D 2240/202; F05D 2240/301
See application file for complete search history.

(56) References Cited

U.S. PATENT DOCUMENTS

| | | | | |
|---|---|---|---|---|
| 2008/0166240 | A1* | 7/2008 | Scott | F01D 5/187<br>416/232 |
| 2017/0101932 | A1* | 4/2017 | Stover | F01D 5/189 |

FOREIGN PATENT DOCUMENTS

| | | | | |
|---|---|---|---|---|
| EP | 3165716 | A1 | | 5/2017 |
| GB | 2210415 | A | | 6/1989 |
| JP | H08-270402 | A | | 10/1996 |
| JP | 2001-207802 | A | | 8/2001 |
| JP | 2001207802 | A | * | 8/2001 |
| JP | 2012-237292 | A | | 12/2012 |
| JP | 2013-124632 | A | | 6/2013 |

* cited by examiner

【FIG. 1】
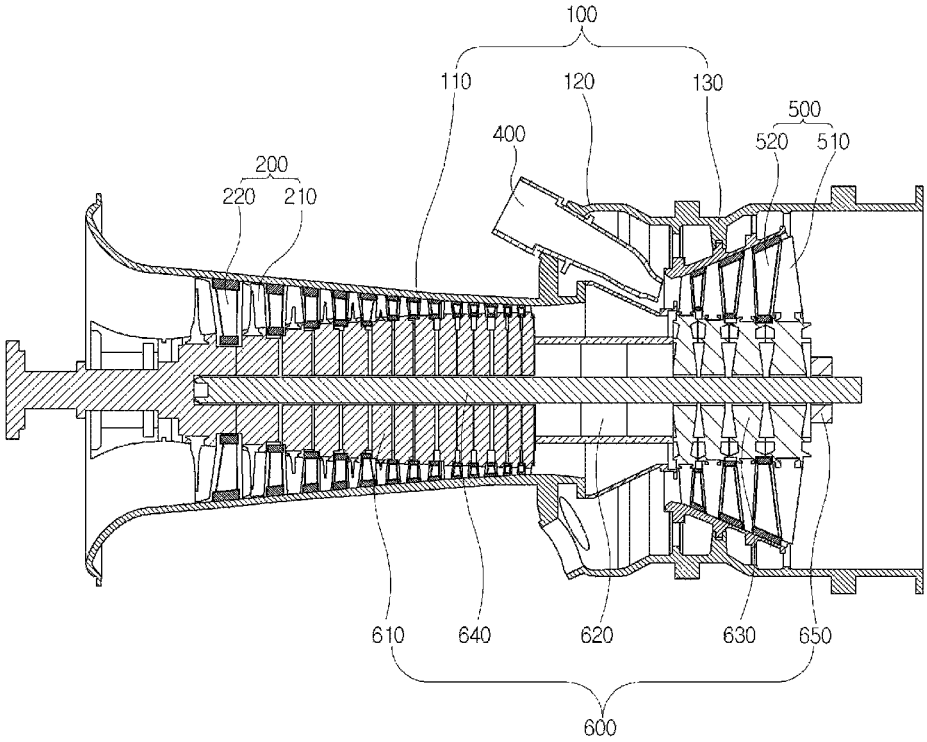

【FIG. 2】
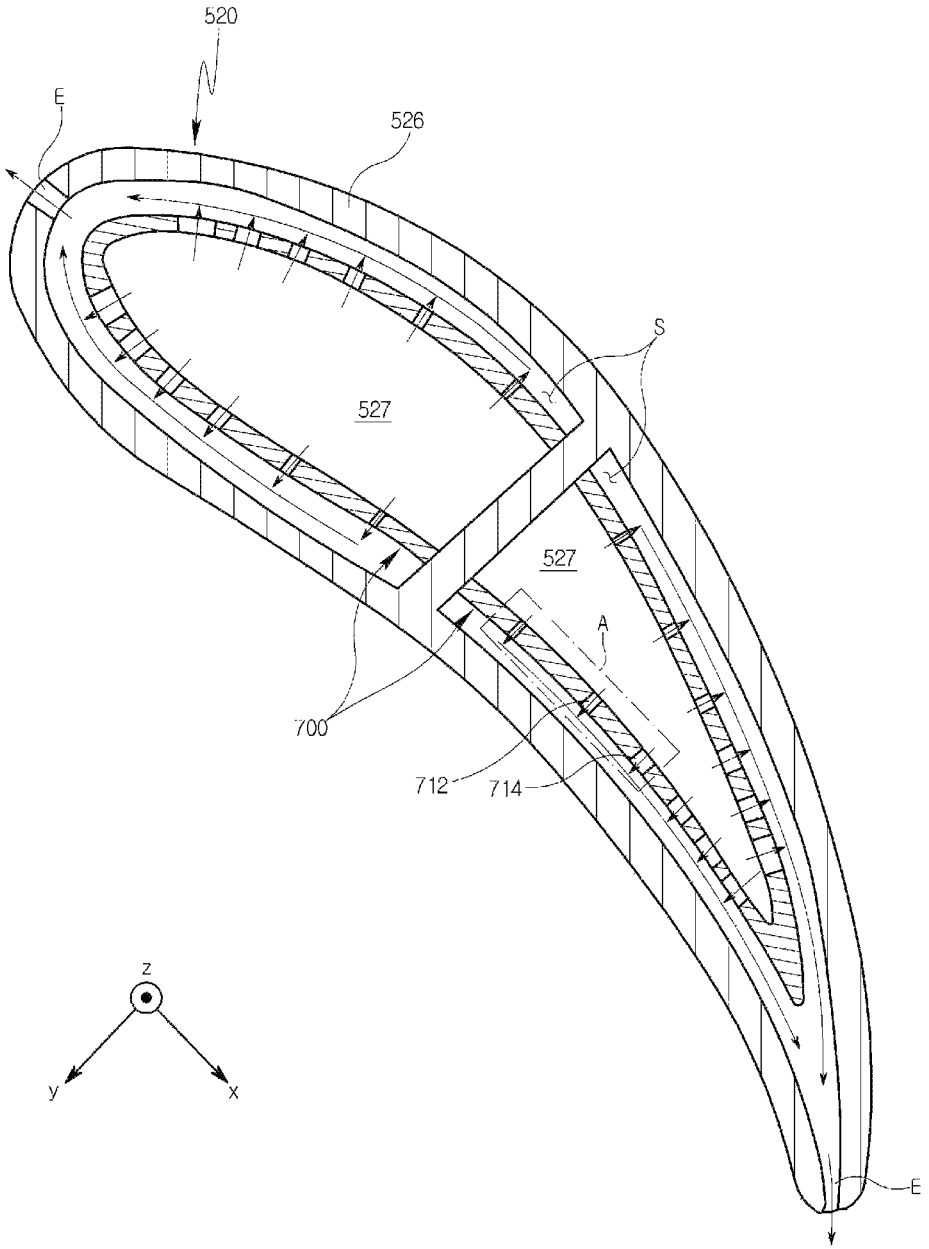

【FIG. 3】
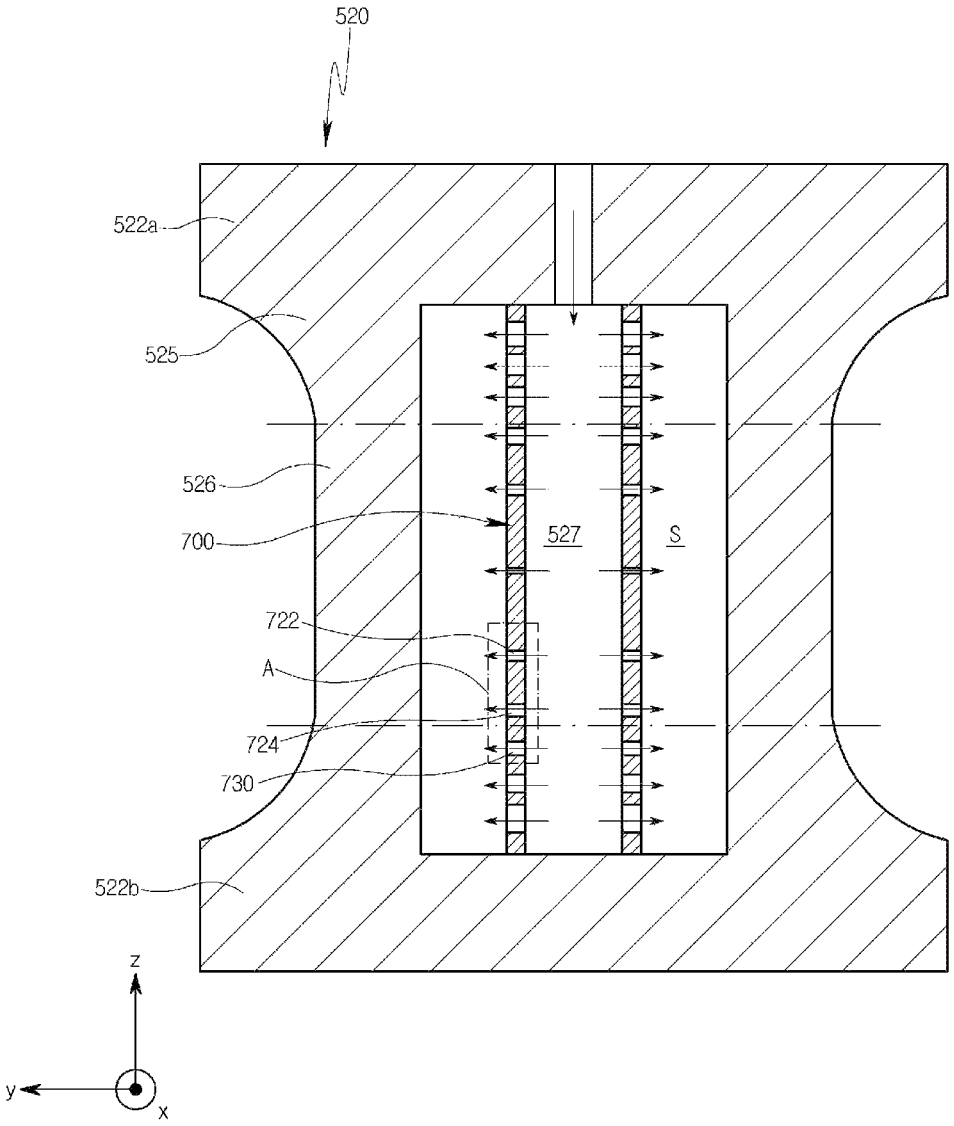

【FIG. 4】
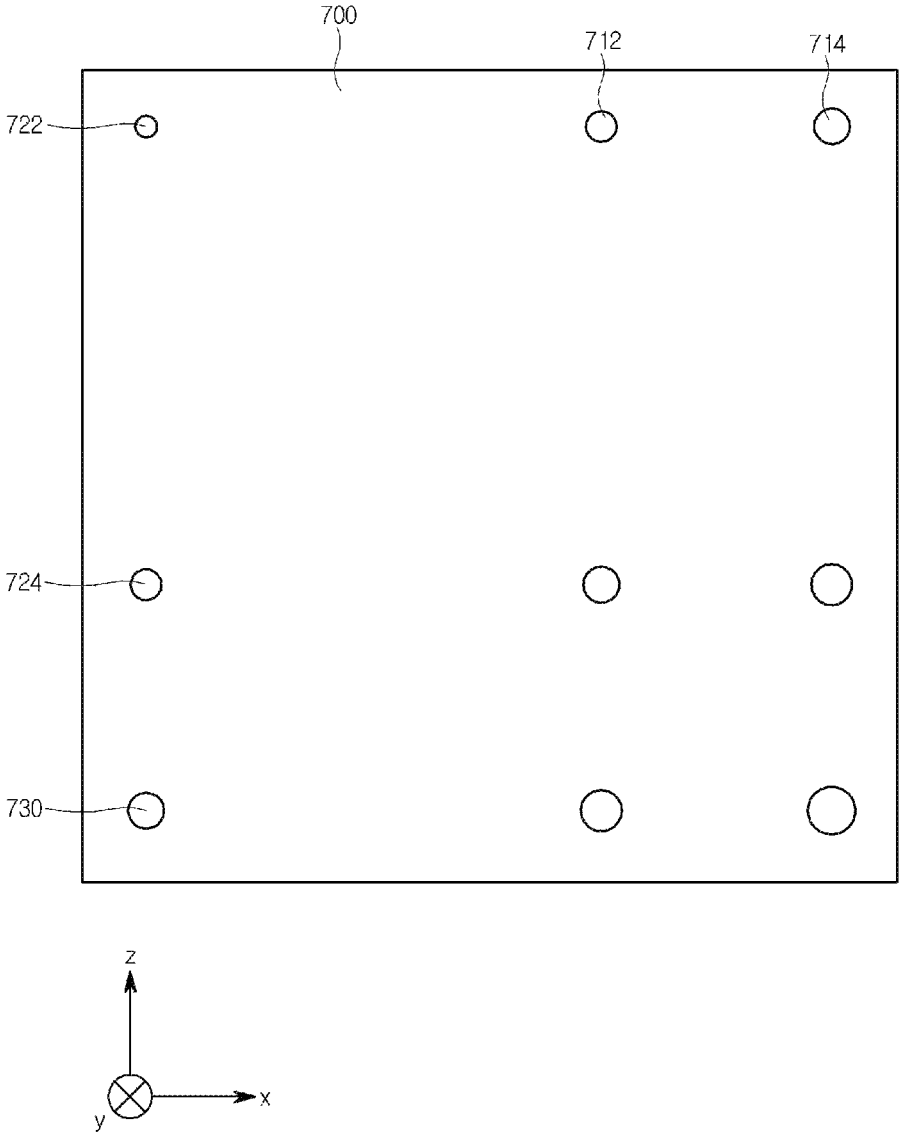

【FIG. 5】
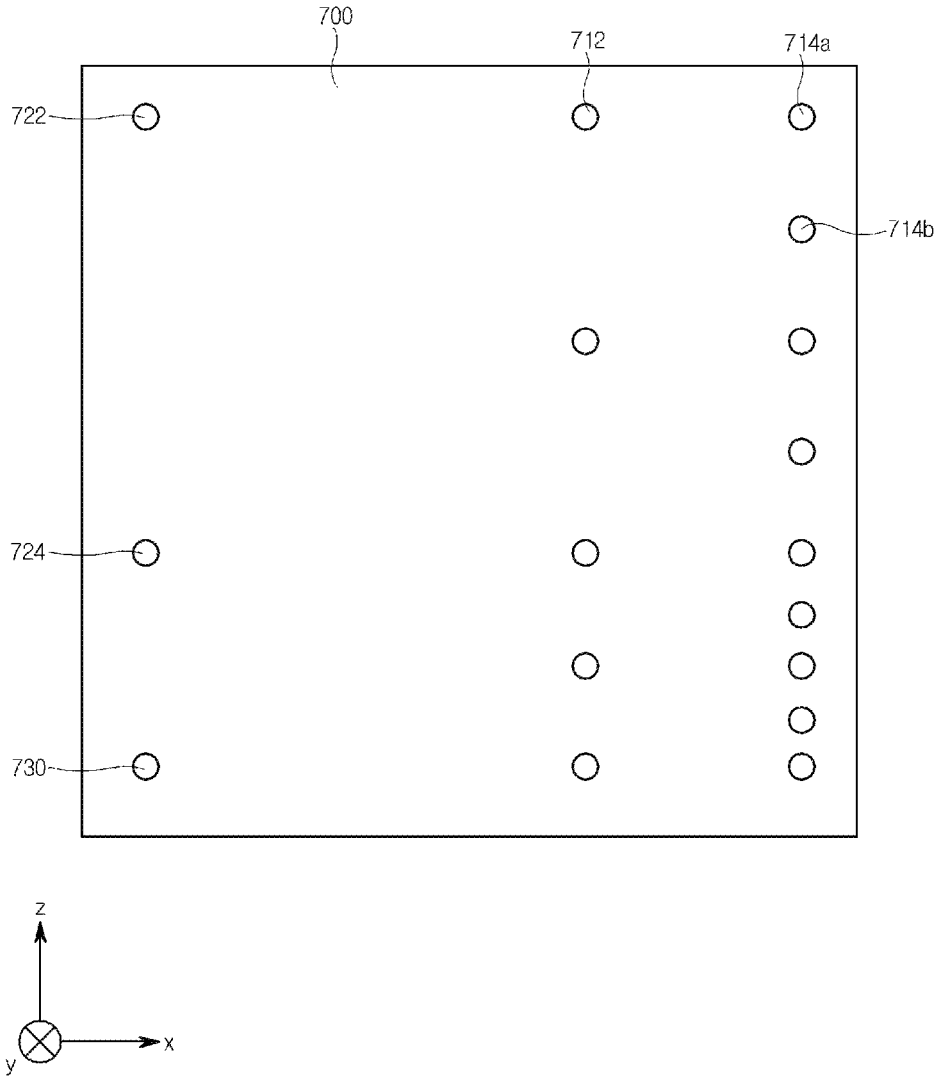

TURBINE VANE HAVING IMPINGEMENT PLATE FOR GAS TURBINE AND GAS TURBINE INCLUDING THE SAME

CROSS-REFERENCE TO RELATED APPLICATION(S)

This application claims priority to Korean Patent Application No(s). 10-2017-0122454, filed on Sep. 22, 2017, the disclosure of which is incorporated herein by reference in its entirety.

BACKGROUND OF THE DISCLOSURE

Field of the Disclosure

Exemplary embodiments of the present disclosure relate to a gas turbine.

Description of the Related Art

Generally, a turbine is a machine which converts energy of fluid such as water, gas, or steam into mechanical work. Typically, a turbo machine, in which a plurality of blades are embedded around a circumferential portion of a rotating body so that the rotating body is rotated at a high speed by impulsive force or reactive force generated by discharging steam or gas to the blades, is referred to as a turbine.

Such turbines are classified into a water turbine using energy of elevated water, a steam turbine using energy of steam, an air turbine using energy of high-pressure compressed air, a gas turbine using energy of high-temperature/high-pressure gas, and so forth.

The gas turbine includes a compressor, a combustor, a turbine, and a rotor.

The compressor includes a plurality of compressor vanes and a plurality of compressor blades which are alternately arranged.

The combustor is configured to supply fuel to air compressed by the compressor and ignite the fuel mixture using a burner, thus generating high-temperature and high-pressure combustion gas.

The turbine includes a plurality of turbine vanes and a plurality of turbine blades which are alternately arranged.

The rotor is provided passing through central portions of the compressor, the combustor, and the turbine. Opposite ends of the rotor are rotatably supported by bearings. One end of the rotor is coupled to a driving shaft of a generator.

The rotor includes a plurality of compressor rotor disks coupled to the respective compressor blades, a plurality of turbine rotor disks coupled to the respective turbine blades, and a torque tube configured to transmit rotating force from the turbine rotor disks to the compressor rotor disks.

In the gas turbine having the above-mentioned configuration, air compressed by the compressor is mixed with fuel and combusted in the combustor, and then is converted into high-temperature combustion gas. The combustion gas formed in the foregoing manner is discharged toward the turbine. The discharged combustion gas passes through the turbine blades and thus generates rotating force. Thereby, the rotor is rotated.

The gas turbine does not have a reciprocating component such as a piston of a four-stroke engine. Therefore, mutual friction parts such as a piston-and-cylinder are not present, so that there are advantages in that there is little consumption of lubricant, the amplitude of vibration is markedly reduced unlike a reciprocating machine having high-amplitude characteristics, and high-speed driving is possible.

Unlike the compressor, the turbine comes into contact with high-temperature and high-pressure combustion gas, and therefore requires a cooling unit for preventing damage, e.g., thermal deterioration. To this end, the turbine further includes a cooling passage through which compressed air, as a cooling fluid, drawn out from portions of the compressor is supplied to the turbine. The cooling passage communicates with a turbine vane cooling passage formed in each turbine vane. The turbine vane cooling passage is provided with an impingement plate having a plurality of injection holes through which air is injected onto an inner wall of the turbine vane, so as to enhance the cooling performance.

However, in the conventional gas turbine having the above-mentioned configuration, the turbine vane is not appropriately cooled, so a temperature gradient occurs in the turbine vane, whereby the turbine vane may be damaged due to thermal stress.

Referring to U.S. Patent 2014/0219788 A1, in a turbine vane of a conventional gas turbine, air (cooling fluid) injected from injection holes of an impingement plate into an impingement space defined between the impingement plate and an inner wall of the turbine vane is impinged against the inner wall of the turbine vane and then discharged out of the turbine vane through an exit hole formed, for example, in a trailing edge of the turbine vane. Here, the injection holes include an upstream-side injection hole disposed at an upstream side with respect to a flow direction of the air in the impingement space, and a downstream-side injection hole disposed at a downstream side with respect to the flow direction of the air in the impingement space. Air that is ejected from the upstream-side injection hole and then flows toward the exit hole may impede ejection of air from the downstream-side injection hole. In other words, a so-called cross flow effect is caused. Hence, the flow rate of air ejected from the downstream-side injection hole is reduced, whereby a region facing the downstream-side injection hole may be insufficiently cooled.

Furthermore, in the conventional gas turbine, the turbine vane is formed such that the flow rate of air injected onto a region having a comparatively thin wall, such as an airfoil, is on the same level as the flow rate of air injected onto a region having a comparatively thick wall, such as a filet. Therefore, the region having the comparatively thick wall may be insufficiently cooled.

SUMMARY OF THE DISCLOSURE

An object of the present disclosure is to provide a gas turbine capable of preventing a temperature gradient or thermal stress from occurring in a turbine vane, which is cooled by cooling fluid ejected from an impingement plate.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, a gas turbine may include a housing; a rotor rotatably provided in the housing; a turbine blade configured to receive rotating force from combustion gas and rotate the rotor; a turbine vane configured to guide a flow of the combustion gas toward the turbine blade, the turbine vane having a turbine vane cooling passage for delivering cooling fluid to an inner wall of the turbine vane; and an impingement plate installed in the turbine vane cooling passage, the impingement plate having a plurality of injection holes through which the cooling fluid is injected onto the inner wall of the turbine vane, the injection holes formed at predetermined locations of the impingement plate. The injection holes may be formed differently depending on locations of the injection holes.

The impingement plate may be spaced apart from the inner wall of the turbine vane so that an impingement space is defined between the impingement plate and the inner wall of the turbine vane. The impingement space may communicate with an exit hole so that cooling fluid ejected from the injection holes into the impingement space drains from the impingement space after having impinged against the inner wall of the turbine vane. The injection holes may include: upstream-side injection holes disposed at an upstream side with respect to a flow direction of the cooling fluid in the impingement space; and downstream-side injection holes disposed at a downstream side with respect to the flow direction of the cooling fluid in the impingement space.

The number of downstream-side injection holes per unit area may be greater than the number of upstream-side injection holes per unit area.

An interval between the downstream-side injection holes may be smaller than an interval between the upstream-side injection holes.

The downstream-side injection holes may include: a first downstream-side injection hole formed to overlap with the upstream-side injection hole with respect to the flow direction of the cooling fluid in the impingement space; and a second downstream-side injection hole formed not to overlap with the upstream-side injection hole with respect to the flow direction of the cooling fluid in the impingement space.

The injection holes may be formed such that the number of injection holes per unit area is gradually increased from the upstream side to the downstream side with respect to the flow direction of the cooling fluid in the impingement space.

An inner diameter of each of the downstream-side injection hole may be greater than an inner diameter of each of the upstream-side injection hole.

The injection holes may be formed such that inner diameters of injection holes are gradually increased from the upstream side to the downstream side with respect to the flow direction of the cooling fluid in the impingement space.

The turbine vane may include: a turbine vane platform part formed in an annular shape along a rotation direction of the rotor; and a turbine vane airfoil part extending from the turbine vane platform part in a rotational radial direction of the rotor. The impingement plate may be configured to inject cooling fluid onto an inner wall of the turbine vane airfoil part. The injection holes may include: a center-side injection hole disposed at a center side with respect to an extension direction of the turbine vane airfoil part; and an end-side injection hole disposed at an end side with respect to the extension direction of the turbine vane airfoil part.

The number of end-side injection holes per unit area may be greater than the number of center-side injection holes per unit area.

The injection holes may be formed such that the number of injection holes per unit area is gradually increased from the center side to the end side with respect to the extension direction of the turbine vane airfoil part.

An inner diameter of each of the end-side injection hole may be greater than an inner diameter of each of the center-side injection hole.

The injection holes may be formed such that inner diameters of the injection holes are gradually increased from the center side to the end side with respect to the extension direction of the turbine vane airfoil part.

The turbine vane may further include a turbine vane fillet part forming a boundary part between the turbine vane platform part and the turbine vane airfoil part. The turbine vane fillet part may be thicker than the turbine vane airfoil part. The impingement plate may be configured to inject cooling fluid onto an inner wall of the turbine vane fillet part.

The injection holes may include: turbine-vane-airfoil-part-side injection holes disposed adjacent to the turbine vane airfoil part; and turbine-vane-fillet-part-side injection holes disposed adjacent to the turbine vane fillet part.

The number of turbine-vane-fillet-part-side injection holes per unit area may be greater than the number of turbine-vane-airfoil-part-side injection holes per unit area.

The injection holes may be formed such that the number of injection holes per unit area is gradually increased from the turbine vane airfoil part to the turbine vane fillet part.

An inner diameter of each of the turbine-vane-fillet-part-side injection holes may be greater than an inner diameter of each of the turbine-vane-airfoil-part-side injection holes.

The injection holes may be formed such that inner diameters of injection holes are gradually increased from the turbine vane airfoil part to the turbine vane fillet part.

In accordance with another aspect of the present disclosure, a gas turbine may include a housing; a turbine blade provided in the housing and configured to be rotated by combustion gas; a turbine vane configured to guide a flow of the combustion gas toward the turbine blade, the turbine vane having a turbine vane cooling passage for delivering cooling fluid to an inner wall of the turbine vane; and an impingement plate installed in the turbine vane cooling passage, the impingement plate having a plurality of injection holes through which the cooling fluid is injected onto the inner wall of the turbine vane. The injection holes may be formed such that the number of injection holes per unit area is gradually increased from an upstream side to a downstream side with respect to a flow direction of the cooling fluid in the impingement space defined between the impingement plate and the inner wall of the turbine vane.

In accordance with yet another aspect of the present disclosure, a gas turbine may include: a housing; a turbine blade provided in the housing and configured to be rotated by combustion gas; and a turbine vane configured to guide a flow of the combustion gas toward the turbine blade. The turbine vane may be provided with an impingement plate having a plurality of injection holes through which cooling fluid for cooling the turbine vane is injected onto an inner wall of the turbine vane. The injection holes may be formed such that inner diameters of injection holes are gradually increased from an upstream side to a downstream side with respect to a flow direction of the cooling fluid in the impingement space defined between the impingement plate and the inner wall of the turbine vane.

In accordance with yet another aspect of the present disclosure, a gas turbine may include: a housing; a rotor rotatably provided in the housing; a turbine blade configured to receive rotating force from combustion gas and rotate the rotor; and a turbine vane configured to guide a flow of the combustion gas toward the turbine blade. The turbine vane may include: a turbine vane platform part formed in an annular shape along a rotation direction of the rotor; a turbine vane airfoil part extending from the turbine vane platform part in a rotational radial direction of the rotor; and a turbine vane fillet part forming a boundary part between the turbine vane platform part and the turbine vane airfoil part. The turbine vane may be provided with an impingement plate having a plurality of injection holes through which cooling fluid for cooling the turbine vane is injected onto an inner wall of the turbine vane. The injection holes may be formed such that the number of injection holes per unit area is gradually increased from a center side toward the turbine vane platform part with respect to an extension direction of the turbine vane airfoil part.

In accordance with yet another aspect of the present disclosure, a gas turbine may include: a housing; a rotor rotatably provided in the housing; a turbine blade configured to receive rotating force from combustion gas and rotate the rotor; and a turbine vane configured to guide a flow of the combustion gas toward the turbine blade. The turbine vane may include: a turbine vane platform part formed in an annular shape along a rotation direction of the rotor; a turbine vane airfoil part extending from the turbine vane platform part in a rotational radial direction of the rotor; and a turbine vane fillet part forming a boundary part between the turbine vane platform part and the turbine vane airfoil part. The turbine vane may be provided with an impingement plate having a plurality of injection holes through which cooling fluid for cooling the turbine vane is injected onto an inner wall of the turbine vane. The injection holes may be formed such that inner diameters of injection holes are gradually increased from a center side toward the turbine vane platform part with respect to an extension direction of the turbine vane airfoil part.

In accordance with yet another aspect of the present disclosure, a gas turbine may include: a housing; a turbine blade provided in the housing and configured to be rotated by combustion gas; and a turbine vane configured to guide a flow of the combustion gas toward the turbine blade. The turbine vane may be provided with an impingement plate having a plurality of injection holes through which cooling fluid for cooling the turbine vane is injected onto an inner wall of the turbine vane. The injection holes may include: an upstream-side injection hole disposed at an upstream side with respect to a flow direction of the cooling fluid in an impingement space defined between the impingement plate and the inner wall of the turbine vane; and a downstream-side injection hole disposed at a downstream side with respect to the flow direction of the cooling fluid in the impingement space. The upstream-side injection hole and the downstream-side injection hole may be formed not to overlap with each other with respect to the flow direction of the cooling fluid in the impingement space.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a sectional view of a gas turbine in accordance with an embodiment of the present disclosure;

FIG. 2 is a cross-sectional view of a turbine vane in the gas turbine of FIG. 1;

FIG. 3 is a longitudinal sectional view of the turbine vane in the gas turbine of FIG. 1;

FIG. 4 is a plan view of portion A of FIGS. 2 and 3; and

FIG. 5 is a plan view illustrating another embodiment of FIG. 4.

DESCRIPTION OF SPECIFIC EMBODIMENTS

Terms or words used hereinafter should not be construed as having common or dictionary meanings, but should be construed as having meanings and concepts that comply with the technical spirit of the present disclosure on the basis of the principle that the inventor may appropriately define the concepts of the terms in order to best describe his or her disclosure. Accordingly, the following description and drawings illustrate exemplary embodiments of the present disclosure and do not fully represent the scope of the present disclosure. It would be understood by one of ordinary skill in the art that a variety of equivalents and modifications of the embodiments exist.

Embodiments of the present disclosure are described in detail below with reference to the accompanying drawings.

In the drawings, the width, length, thickness, etc. of each element may have been enlarged for convenience. Furthermore, when it is described that one element is disposed 'over' or 'on' the other element, one element may be disposed 'right over' or 'right on' the other element or a third element may be disposed between the two elements. The same reference numbers are used throughout the specification to refer to the same or like parts.

Hereinafter, a gas turbine in accordance with the present disclosure will be described with reference to the accompanying drawings.

Referring to FIGS. 1 to 4, the gas turbine in accordance with an embodiment of the present disclosure may include a housing 100, a rotor 600, a compressor 200, a combustor 400, a turbine 500, a generator, and a diffuser. The rotor 600 may be rotatably provided in the housing 100. The compressor 200 may receive rotating force from the rotor 600 and compress air drawn into the housing 100. The combustor 400 may mix fuel with air compressed by the compressor 200, and ignite the fuel mixture to generate combustion gas. The turbine 500 may obtain rotating force from the combustion gas generated from the combustor 400, and rotate the rotor 600 using the rotating force. The generator may be interlocked with the rotor 600 to produce electricity. The diffuser may discharge combustion gas that has passed through the turbine 500.

The housing 100 may include a compressor housing 110 which houses the compressor 200, a combustor housing 120 which houses the combustor 400, and a turbine housing 130 which houses the turbine 500.

The compressor housing 110, the combustor housing 120, and the turbine housing 130 may be successively arranged from an upstream side to a downstream side in a fluid flow direction.

The rotor 600 may include a compressor rotor disk 610, a turbine rotor disk 630, a torque tube 620, a tie rod 640, and a fastening nut 650. The compressor rotor disk 610 may be housed in the compressor housing 110. The turbine rotor disk 630 may be housed in the turbine housing 130. The torque tube 620 may be housed in the combustor housing 120 and couple the compressor rotor disk 610 with the turbine rotor disk 630. The tie rod 640 and the fastening nut 650 may couple the compressor rotor disk 610, the torque tube 620, and the turbine rotor disk 630 with each other.

In the embodiment, a plurality of compressor rotor disks 610 may be provided. The plurality of compressor rotor disks 610 may be arranged along an axial direction of the rotor 600. In other words, the compressor rotor disks 610 may form a multi-stage structure.

Each compressor rotor disk 610 may have an approximately circular plate shape, and include in an outer circumferential surface thereof a compressor blade coupling slot through which a compressor blade 210 (described later) is coupled to the compressor rotor disk 610.

The compressor blade coupling slot may have a fir-tree shape to prevent the compressor blade 210 from being undesirably removed from the compressor blade coupling slot in a rotational radial direction of the rotor 600.

Here, the compressor rotor disk 610 and the compressor blade 210 are generally coupled to each other in a tangential type or an axial type scheme. In the present embodiment, the axial type scheme is used. Accordingly, in the present embodiment, a plurality of compressor blade coupling slots may be formed. The plurality of compressor blade coupling slots may be arranged along a circumferential direction of the compressor rotor disk 610.

The turbine rotor disk 630 may be formed in a manner similar to that of the compressor rotor disk 610. That is, a plurality of turbine rotor disks 630 may be provided. The plurality of turbine rotor disks 630 may be arranged along the axial direction of the rotor 600. In other words, the turbine rotor disks 630 may form a multi-stage structure.

Furthermore, each turbine rotor disk 630 may have an approximately circular plate shape, and include in an outer circumferential surface thereof a turbine blade coupling slot through which a turbine blade 510 to be described later herein is coupled to the turbine rotor disk 630.

The turbine blade coupling slot may have a fir-tree shape to prevent the turbine blade 510 (described later) from being undesirably removed from the turbine blade coupling slot in the rotational radial direction of the rotor 600.

Here, the turbine rotor disk 630 and the turbine blade 510 to be described later herein are generally coupled to each other in a tangential type or an axial type scheme. In the present embodiment, the axial type scheme is used. Accordingly, in the present embodiment, a plurality of turbine blade coupling slots may be formed. The plurality of turbine blade coupling slots may be arranged along a circumferential direction of the turbine rotor disk 630.

The torque tube 620 may be a torque transmission unit configured to transmit the rotating force of the turbine rotor disks 630 to the compressor rotor disks 610. One end of the torque tube 620 may be coupled to one of the plurality of compressor rotor disks 610 that is disposed at the most downstream end with respect to an air flow direction. The other end of the torque tube 620 may be coupled to one of the plurality of turbine rotor disks 630 that is disposed at the most upstream end with respect to a combustion gas flow direction. Here, a protrusion may be provided on each end of the torque tube 620. A depression to engage with the corresponding protrusion may be formed in each of the associated compressor rotor disk 610 and the associated turbine rotor disk 630. Thereby, the torque tube 620 may be prevented from rotating relative to the compressor rotor disk 610 or the turbine rotor disk 630.

The torque tube 620 may have a hollow cylindrical shape to allow air supplied from the compressor 200 to flow into the turbine 500 via the torque tube 620.

Taking into account characteristics of the gas turbine that is continuously operated for a long period of time, the torque tube 620 may be formed to resist to deformation, distortion, etc., and designed to be easily assembled or disassembled to facilitate maintenance.

The tie rod 640 may be provided passing through the plurality of compressor rotor disks 610, the torque tube 620, and the plurality of turbine rotor disks 630. One end of the tie rod 640 may be coupled in one of the plurality of compressor rotor disks 610 that is disposed at the most upstream end with respect to the air flow direction. The other end of the tie rod 640 may protrude, in a direction opposite to the compressor 200, based on one of the plurality of turbine rotor disks 630 that is disposed at the most downstream end with respect to the combustion gas flow direction, and may be coupled to the fastening nut 650.

Here, the fastening nut 650 may compress, toward the compressor 200, the turbine rotor disk 630 that is disposed at the most downstream end. Thus, as the distance between the compressor rotor disk 610 that is disposed at the most upstream end and the turbine rotor disk 630 that is disposed at the most downstream end is reduced, the plurality of compressor rotor disks 610, the torque tube 620, and the plurality of turbine rotor disks 630 may be compressed with respect to the axial direction of the rotor 600. Consequently, the plurality of compressor rotor disks 610, the torque tube 620, and the plurality of turbine rotor disks 630 may be prevented from moving in the axial direction or rotating relative to each other.

In the present embodiment, the single tie rod 640 may pass through the central portions of the plurality of compressor rotor disks 610, the torque tube 620, and the plurality of turbine rotor disks 630. However, the present disclosure is not limited to this structure. For example, separate tie rods 640 may be respectively provided in the compressor 200 and the turbine 500, or a plurality of tie rods 640 may be arranged along the circumferential direction. A combination of these structures is also possible.

In accordance with the above-mentioned configuration, opposite ends of the rotor 600 may be rotatably supported by bearings, and one end thereof may be coupled to a driving shaft of the generator.

The compressor 200 may include the compressor blade 210 which rotates along with the rotor 600, and a compressor vane 220 which is fixed in the housing 100 and configured to guide the flow of air toward the compressor blade 210 so that the guided air is better aligned with respect to an airfoil of the compressor blade 210.

In the embodiment, a plurality of compressor blades 210 may be provided. The plurality of compressor blades 210 may form a multi-stage structure along the axial direction of the rotor 600. A plurality of compressor blades 210 may be provided in each stage, and may be radially formed and arranged along a rotation direction of the rotor 600.

Each compressor blade 210 may include a planar compressor blade platform part, a compressor blade root part, and a compressor blade airfoil part. The compressor blade root part may extend from the compressor blade platform part toward a central side of the rotor 600 with respect to the rotational radial direction of the rotor 600. The compressor blade airfoil part may extend from the compressor blade platform part toward a centrifugal side of the rotor 600 with respect to the rotational radial direction of the rotor 600.

The compressor blade platform part may come into contact with an adjacent compressor blade platform part, and function to maintain a distance between the adjacent compressor blade airfoil parts.

The compressor blade root part may have a so-called axial type form, which is inserted into the compressor blade coupling slot along the axial direction of the rotor 600, as described above.

Furthermore, the compressor blade root part may have a fir-tree shape to correspond to the compression blade coupling slot.

Here, in the present embodiment, each of the compressor blade root part and the compressor blade coupling slot is described as having a fir-tree shape, but the present disclosure is not limited thereto. For example, each blade root may have a dovetail shape or the like. Alternatively, the compressor blade 210 may be coupled to the compressor rotor disk 610 by using a separate coupling device, e.g., a fastener such as a key or a bolt, other than the above-mentioned coupling scheme.

With regard to the compressor blade root part and the compressor blade coupling slot, the size of the compressor blade coupling slot may be greater than that of the compressor blade root part so as to facilitate the coupling of the compressor blade root part with the compressor blade coupling slot. In the coupled state, a clearance may be formed between the compressor blade root part and the compressor blade coupling slot.

Although not shown, the compressor blade root part and the compressor blade coupling slot may be fixed to each other by a separate pin so that the compressor blade root part may be prevented from being undesirably removed from the compressor blade coupling slot in the axial direction of the rotor 600.

The compressor blade airfoil part may be formed to have an optimized profile according to specifications of the gas turbine. The compressor blade airfoil part may include a compressor-blade-airfoil-part leading edge which is disposed at an upstream side with respect to the air flow direction so that air is incident on the leading edge, and a compressor-blade-airfoil-part trailing edge which is disposed at a downstream side with respect to the air flow direction so that air exits the trailing edge.

In the embodiment, a plurality of compressor vanes 220 may be provided. The plurality of compressor vanes 220 may form a multi-stage structure along the axial direction of the rotor 600. Here, the compressor vanes 220 and the compressor blades 210 may be alternately arranged along the air flow direction.

Furthermore, a plurality of compressor vanes 220 may be provided in each stage, and may be radially formed and arranged along the rotation direction of the rotor 600.

Each compressor vane 220 may include a compressor vane platform part which, collectively, may form an annular shape along the rotation direction of the rotor 600, and a compressor vane airfoil part which extends from the compressor vane platform part in the rotational radial direction of the rotor 600.

The compressor vane platform part may include a root-side compressor vane platform part which is formed in a vane root part of the compressor vane airfoil part and coupled to the compressor housing 110, and a tip-side compressor vane platform part which is formed in a vane tip part of the compressor vane airfoil part and faces the rotor 600.

Here, the compressor vane platform part in accordance with the present embodiment includes the root-side compressor vane platform part and the tip-side compressor vane platform part so as to support not only the vane root part of the compressor vane airfoil part but also the vane tip part thereof and thus more stably support the compressor vane airfoil part. However, the present disclosure is not limited to the foregoing structure. For example, the compressor vane platform part may include only the root-side compressor vane platform part to support only the vane root part of the compressor vane airfoil part.

Each compressor vane 220 may further include a compressor vane root part for coupling the root-side compressor vane platform part with the compressor housing 110.

The compressor vane airfoil part may be formed to have an optimized profile according to specifications of the gas turbine. The compressor vane airfoil part may include a compressor-vane-airfoil-part leading edge which is disposed at an upstream side with respect to the air flow direction so that air is incident on the leading edge, and a compressor-vane-airfoil-part trailing edge which is disposed at a downstream side with respect to the air flow direction so that air exits the trailing edge.

The combustor 400 functions to mix air supplied from the compressor 200 with fuel and combust the fuel mixture to generate high-temperature and high-pressure combustion gas having high energy, and may be configured to increase the temperature of the combustion gas to a heat resistance limit within which the combustor 400 and the turbine 500 can resist heat in a constant-pressure combustion process.

In detail, a plurality of combustors 400 may be provided. The plurality of combustors 400 may be arranged on the combustor housing 120 along the rotation direction of the rotor 600.

Each combustor 400 may include a liner into which air compressed by the compressor 200 is drawn, a burner configured to inject fuel to the air drawn into the liner and combust the fuel mixture, and a transition piece configured to guide combustion gas generated by the burner to the turbine 500.

The liner may include a flame tube which defines a combustion chamber, and a flow sleeve which encloses the flame tube and forms an annular space.

The burner may include a fuel injection nozzle provided on a front end side of the liner to inject fuel to air drawn into the combustion chamber, and an ignition plug provided in a sidewall of the liner to ignite the fuel mixture formed by mixing the fuel with the air in the combustion chamber.

The transition piece may be configured such that an outer wall of the transition piece can be cooled by air supplied from the compressor 200 so as to prevent the transition piece from being damaged by high-temperature combustion gas.

In detail, a cooling hole is formed in the transition piece so that air can be injected into the transition piece through the cooling hole so as to cool a main body of the transition piece.

Air used to cool the transition piece may flow into the annular space of the liner, and collide with air provided as cooling air from the outside of the flow sleeve through a cooling hole formed in the flow sleeve that forms the outer wall of the liner.

Although not shown, a deswirler functioning as a guide vane may be provided between the compressor 200 and the combustor 400 so as to adjust a flow angle, at which air is drawn into the combustor 400, to a design flow angle.

The turbine 500 may be formed in a manner similar to that of the compressor 200.

In detail, the turbine 500 may include the turbine blade 510 which rotates along with the rotor 600, and a turbine vane 520 which is fixed in the housing 100 and configured to align the flow of combustion gas to be drawn onto the turbine blade 510.

In the embodiment, a plurality of turbine blades 510 may be provided. The plurality of turbine blades 510 may form a multi-stage structure along the axial direction of the rotor 600. A plurality of turbine blades 510 may be provided in each stage, and may be radially formed and arranged along the rotation direction of the rotor 600.

Each turbine blade 510 may include a planar turbine blade platform part, a turbine blade root part, and a turbine blade airfoil part. The turbine blade root part may extend from the turbine blade platform part toward a central side of the rotor 600 with respect to the rotational radial direction of the rotor 600. The turbine blade airfoil part may extend from the turbine blade platform part toward a centrifugal side of the rotor 600 with respect to the rotational radial direction of the rotor 600.

The turbine blade platform part may come into contact with an adjacent turbine blade platform part, and function to maintain a distance between the adjacent turbine blade airfoil parts.

The turbine blade root part may have a so-called axial type form, which is inserted into the turbine blade coupling slot along the axial direction of the rotor 600, as described above.

Furthermore, the turbine blade root part may have a fir-tree shape to correspond to the turbine blade coupling slot.

Here, in the present embodiment, each of the turbine blade root part and the turbine blade coupling slot is described as having a fir-tree shape, but the present disclosure is not limited thereto, and, for example, each may have a dovetail shape or the like. Alternatively, the turbine blade 510 may be coupled to the turbine rotor disk 630 by using a separate coupling device, e.g., a fastener such as a key or a bolt, other than the above-mentioned coupling scheme.

With regard to the turbine blade root part and the turbine blade coupling slot, the size of the turbine blade coupling slot may be greater than that of the turbine blade root part so as to facilitate the coupling of the turbine blade root part with the turbine blade coupling slot. In the coupled state, a clearance may be formed between the turbine blade root part and the turbine blade coupling slot.

Although not shown, the turbine blade root part and the turbine blade coupling slot may be fixed to each other by a separate pin so that the turbine blade root part may be prevented from being undesirably removed from the turbine blade coupling slot in the axial direction of the rotor 600.

The turbine blade airfoil part may be formed to have an optimized profile according to specifications of the gas turbine. The turbine blade airfoil part may include a turbine-blade-airfoil-part leading edge which is disposed at an upstream side with respect to the combustion gas flow direction so that combustion gas is incident on the leading edge, and a turbine-blade-airfoil-part trailing edge which is disposed at a downstream side with respect to the combustion gas flow direction so that combustion gas exits the trailing edge.

In the embodiment, a plurality of turbine vanes 520 may be provided. The plurality of turbine vanes 520 may form a multi-stage structure along the axial direction of the rotor 600. Here, the turbine vanes 520 and the turbine blades 510 may be alternately arranged along the air flow direction.

Furthermore, a plurality of turbine vanes 520 may be provided in each stage, and may be radially formed and arranged along the rotation direction of the rotor 600.

Each turbine vane 520 may include a turbine vane platform part 522 which, collectively, form an annular shape along the rotation direction of the rotor 600, and a turbine vane airfoil part 526 which extends from the turbine vane platform part 522 in the rotational radial direction of the rotor 600.

The turbine vane platform part 522 may include a root-side turbine vane platform part 522*a* which is formed in a vane root part of the turbine vane airfoil part 526 and coupled to the turbine housing 130, and a tip-side turbine vane platform part 522*b* which is formed in a vane tip part of the turbine vane airfoil part 526 and faces the rotor 600.

Here, the turbine vane platform part 522 in accordance with the present embodiment includes the root-side turbine vane platform part 522*a* and the tip-side turbine vane platform part 522*b* so as to support not only the vane root part of the turbine vane airfoil part 526 but also the vane tip part thereof and thus more stably support the turbine vane airfoil part 526. However, the present disclosure is not limited to the foregoing structure. For example, the turbine vane platform part 522 may include only the root-side turbine vane platform part 522*a* to support only the vane root part of the turbine vane airfoil part 526.

Each turbine vane 520 may further include a turbine vane root part for coupling the root-side turbine vane platform part 522*a* with the turbine housing 130.

The turbine vane airfoil part 526 may be formed to have an optimized profile according to specifications of the gas turbine. The turbine vane airfoil part 526 may include a turbine-vane-airfoil-part leading edge which is disposed at an upstream side with respect to the combustion gas flow direction so that combustion gas is incident on the leading edge, and a turbine-vane-airfoil-part trailing edge which is disposed at a downstream side with respect to the combustion gas flow direction so that combustion gas exits the trailing edge.

Here, unlike the compressor 200, the turbine 500 makes contact with high-temperature and high-pressure combustion gas. Hence, the turbine 500 requires a cooling unit for preventing damage such as thermal deterioration.

Given this, the gas turbine in accordance with the present embodiment may further include a cooling passage through which compressed air drawn out from some portions of the compressor 200 is supplied to the turbine 500.

The cooling passage may extend outside the housing 100 (defined as an external passage), or extend through the interior of the rotor 600 (defined as an internal passage). Alternatively, both the external passage and the internal passage may be used.

Furthermore, the cooling passage may communicate with a turbine blade cooling passage formed in the turbine blade 510 so that the turbine blade 510 can be cooled by air acting as a cooling fluid. Hereinafter, in the present disclosure, references to air flowing or acting in any cooling capacity should be understood to include other cooling fluids.

The turbine blade cooling passage may communicate with a turbine blade film cooling hole formed in the surface of the turbine blade 510, so that air (as a cooling fluid) is supplied to the surface of the turbine blade 510, whereby the turbine blade 510 may be cooled in a so-called film cooling manner by the cooling air.

In addition, the turbine vane 520 may also be formed to be cooled by air supplied from the cooling passage, in a manner similar to that of the turbine blade 510. In detail, a turbine vane cooling passage 527 may be formed in the turbine vane 520 so that air supplied from the cooling passage flows through the turbine vane cooling passage 527. Furthermore, within the turbine vane cooling passage 527 is installed an impingement plate 700 including a plurality of injection holes 712, 714, 722, 724, and 730. The injection holes of the present embodiment are formed at predetermined locations of the impingement plate 700 and eject air at an increased flow rate, to impinge the air against an inner wall of the turbine vane 520 so as to enhance cooling performance. The impingement plate 700 may be spaced apart from the inner wall of the turbine vane 520 so that an impingement space S is defined between the impingement plate 700 and the inner wall of the turbine vane 520. The impingement space S may communicate with an exit hole E so that air ejected from the injection holes 712, 714, 722, 724, and 730 into the impingement space S can be drained out of the impingement space S after having impinged against the inner wall of the turbine vane 520.

The turbine 500 may have need of a clearance between the inner circumferential surface of the turbine housing 130 and a blade tip of each turbine blade 510 to allow the turbine blades 510 to smoothly rotate.

However, as the clearance is increased, it is advantageous for preventing interference between the turbine blade 510 and the turbine housing 130, but it is disadvantageous in terms of leakage of combustion gas. Reducing the clearance has the opposite effect. In detail, the flow of combustion gas discharged from the combustor 400 is divided into a main flow which passes through the turbine blades 510, and a leakage flow which passes through the clearance between the turbine blades 510 and the turbine housing 130. As the clearance is increased, the leakage flow rate is increased, thus reducing the efficiency of the gas turbine, but interference between the turbine blades 510 and the turbine housing 130 due to thermal deformation or the like can be prevented, and damage caused by the interference can also be prevented. Conversely, as the clearance is reduced, the leakage flow rate is reduced so that the efficiency of the gas turbine can be enhanced, but interference between the turbine blades 510 and the turbine housing 130 due to thermal deformation or the like may be induced, and damage resulting from the interference may be caused.

Given this, the gas turbine in accordance with the present embodiment may further include a sealing unit (not shown) configured to provide an appropriate clearance at which interference between the turbine blade 510 and the turbine housing 130 and damage resulting from the interference can be prevented, and a reduction in efficiency of the gas turbine can be minimized.

The sealing unit may include a shroud disposed on the blade tip of the turbine blade 510, a labyrinth seal which protrudes from the shroud toward the centrifugal side of the rotor 600 with respect to the rotational radial direction of the rotor 600, and a honeycomb seal installed on the inner circumferential surface of the turbine housing 130.

The sealing unit having the foregoing configuration may form an appropriate clearance between the labyrinth seal and the honeycomb seal so that the reduction in efficiency of the gas turbine due to leakage of combustion gas can be minimized, and the shroud that rotates at high speeds and the honeycomb seal that remains stationary can be prevented from coming into direct contact with each other, whereby damage resulting from the direct contact can also be prevented.

In addition, the turbine 500 may further include a sealing unit (not shown) for preventing leakage between the turbine vanes 520 and the rotor 600. This sealing unit may employ a brush seal, etc. as well as the above-mentioned labyrinth seal.

In the gas turbine having the above-mentioned configuration, air drawn into the housing 100 is compressed by the compressor 200. The air compressed by the compressor 200 is mixed with fuel by the combustor 400, and then the fuel mixture is combusted by the combustor 400, so that combustion gas is generated. The combustion gas generated by the combustor 400 is drawn into the turbine 500. The combustion gas drawn into the turbine 500 passes through the turbine blades 510 and thus rotates the rotor 600, before being discharged to the atmosphere through the diffuser. The rotor 600 that is rotated by the combustion gas may drive the compressor 200 and the generator. In other words, some of mechanical energy obtained from the turbine 500 may be supplied as energy needed for the compressor 200 to compress air, and the other mechanical energy may be used to produce electricity in the generator.

In contrast, in the gas turbine in accordance with the present embodiment, the injection holes 712, 714, 722, 724, and 730 that inject air onto the inner wall of the turbine vane 520 may be formed differently depending on locations of the injection holes 712, 714, 722, 724, and 730, so as to prevent a temperature gradient or thermal stress from occurring in the turbine vane 520.

In detail, to enable air to be injected onto the entire region of the turbine vane 520 with respect to a flow direction (x-axis direction of FIGS. 2 and 4) of the air in the impingement space S, the injection holes 712, 714, 722, 724, and 730 may include an upstream-side injection hole 712 disposed at an upstream side with respect to the flow direction (x-axis direction of FIGS. 2 and 4) of the air in the impingement space S, and a downstream-side injection hole 714 disposed at a downstream side with respect to the flow direction (x-axis direction of FIGS. 2 and 4) of the air in the impingement space S.

Furthermore, the injection holes 712, 714, 722, 724, and 730 may be provided such that the number of downstream-side injection holes 714 per unit area (i.e., per unit area of the impingement plate) is greater than that of the upstream-side injection holes 712. Thus, even if a cross flow effect (a phenomenon whereby ejection of air from the downstream-side injection holes 714 is impeded by air that flows toward the exit hole E after having been ejected from the upstream-side injection holes 712) is caused, the flow rate of air ejected from the downstream-side injection holes 714 can be a predetermined flow rate value or more so that a region of the turbine vane 520 that faces the downstream-side injection holes 714 can be satisfactorily cooled. In other words, with respect to the flow direction (x-axis direction of FIGS. 2 and 4) of the air in the impingement space S, the downstream-side injection holes 714 may be spaced apart from each other at intervals less than that of the upstream-side injection holes 712.

Taking into account the fact that the cross flow effect is gradually intensified from the upstream side to the downstream side with respect to the flow direction (x-axis direction of FIGS. 2 and 4) of air in the impingement space S, it may be preferable that the injection holes 712, 714, 722, 724, and 730 be formed such that the number of injection holes 712, 714, 722, 724, and 730 per unit area is gradually increased from the upstream side to the downstream side with respect to the flow direction (x-axis direction of FIGS. 2 and 4) of air in the impingement space S.

As an alternative scheme of making the flow rate of air ejected from the downstream-side injection holes 714 greater than or equal to the preset flow rate value even when the cross flow effect is caused, the injection holes 712, 714, 722, 724, and 730 may be formed such that an inner diameter of each downstream-side injection hole 714 is greater than that of each upstream-side injection hole 712.

Taking into account the fact that the cross flow effect is gradually intensified from the upstream side to the downstream side with respect to the flow direction (x-axis direction of FIGS. 2 and 4) of air in the impingement space S, it may also be preferable that the injection holes 712, 714, 722, 724, and 730 be formed such that the inner diameters of the injection holes 712, 714, 722, 724, and 730 are gradually increased from the upstream side to the downstream side with respect to the flow direction (x-axis direction of FIGS. 2 and 4) of air in the impingement space S.

Furthermore, the impingement plate 700 is configured to inject air onto an inner wall of the turbine vane airfoil part 526. To enable air to be injected onto the entire region of the turbine vane airfoil part 526 with respect to an extension direction (z-axis direction of FIGS. 3 and 4) of the turbine vane airfoil part 526, the injection holes 712, 714, 722, 724, and 730 may include a center-side injection hole 722 disposed at a center side with respect to the extension direction (z-axis direction of FIGS. 3 and 4) of the turbine vane airfoil part 526, and an end-side injection hole 724 disposed at an end side with respect to the extension direction (z-axis direction of FIGS. 3 and 4) of the turbine vane airfoil part 526.

Furthermore, the injection holes 712, 714, 722, 724, and 730 may be formed such that the number of end-side injection holes 724 per unit area is greater than that of the center-side injection holes 722 so that the rate at which air is impinged on the end side of the turbine vane airfoil part 526 that has a relatively thick wall can be greater than that of the center side of the turbine vane airfoil part 526 that has a relatively thin wall, whereby the end side of the turbine vane airfoil part 526 can be cooled at a rate higher than that of the center side. In other words, with respect to the extension direction (z-axis direction of FIGS. 3 and 4) of the turbine vane airfoil part 526, the end-side injection holes 724 may be spaced apart from each other at intervals of less than that of the center-side injection holes 722.

Taking into account the fact that the thickness of the wall of the turbine vane airfoil part 526 is gradually increased from the center side to the end side, it may be preferable that the injection holes 712, 714, 722, 724, and 730 be formed such that the number of injection holes 712, 714, 722, 724, and 730 per unit area is gradually increased from the center side to the end side.

As an alternative scheme of making the rate at which air impinges on the end side higher than that of the center side, the injection holes 712, 714, 722, 724, and 730 may be formed such that an inner diameter of each end-side injection hole 724 is greater than that of each center-side injection hole 722.

Taking into account the fact that the thickness of the wall of the turbine vane airfoil part 526 is gradually increased from the center side to the end side, it may also be preferable that the injection holes 712, 714, 722, 724, and 730 be formed such that the inner diameters of the injection holes 712, 714, 722, 724, and 730 are gradually increased from the center side to the end side.

Furthermore, the turbine vane 520 may include a turbine vale fillet part 525 which is a boundary part between the turbine vane platform part 522 and the turbine vane airfoil part 526. The turbine vale fillet part 525 may be formed to be thicker than the turbine vane airfoil part 526 so as to increase the rigidity of the turbine vale fillet part 525. Here, the impingement plate 700 may be formed to inject air onto an inner wall of the turbine vane fillet part 525 so as to also cool the turbine vane fillet part 525. In other words, the injection holes 712, 714, 722, 724, and 730 may also include a turbine-vane-fillet-side injection hole 730 which is disposed adjacent to the turbine vane fillet part 525, as well as including the center-side injection hole 722 and the end-side injection hole 724 (hereinafter referred to as "turbine-vane-airfoil-part-side injection holes 722 and 724") that are disposed adjacent to the turbine vane airfoil part 526.

Here, the injection holes 712, 714, 722, 724, and 730 may be formed such that the number of turbine-vane-fillet-part-side injection holes 730 per unit area is greater than that of the turbine-vane-airfoil-part-side injection holes 722 and 724 so that the rate at which air is impinged on the turbine vane fillet part 525 that has a relatively thick wall can be greater than that of the turbine vane airfoil part 526 that has a relatively thin wall, whereby the turbine vane fillet part 525 can be cooled at a rate higher than that of the turbine vane airfoil part 526. In other words, with respect to the extension direction (z-axis direction of FIGS. 3 and 4) of the turbine vane airfoil part 526, the turbine-vane-fillet-part-side injection holes 730 may be spaced apart from each other at intervals less than that of the turbine-vane-airfoil-part-side injection holes 722 and 724.

Taking into account the fact that the thickness of the wall of the turbine vane 520 is gradually increased from the turbine vane airfoil part 526 to the turbine vane fillet part 525, it may be preferable that the injection holes 712, 714, 722, 724, and 730 be formed such that the number of injection holes 712, 714, 722, 724, and 730 per unit area is gradually increased from the turbine vane airfoil part 526 to the turbine vane fillet part 525.

As an alternative scheme of making the rate at which air impinges on the turbine vane fillet part 525 higher than that of the turbine vane airfoil part 526, the injection holes 712, 714, 722, 724, and 730 may be formed such that an inner diameter of each turbine-vane-fillet-part-side injection hole 730 is greater than that of each turbine-vane-airfoil-part-side injection hole 722 or 724.

Taking into account the fact that the thickness of the wall of the turbine vane 520 is gradually increased from the turbine vane airfoil part 526 to the turbine vane fillet part 525, it may be preferable that the injection holes 712, 714, 722, 724, and 730 be formed such that the inner diameters of the injection holes 712, 714, 722, 724, and 730 are gradually increased from the turbine vane airfoil part 526 to the turbine vane fillet part 525.

In the turbine vane 520 having the above-mentioned configuration, regions disposed at the downstream side with respect to the flow direction of air and regions each having a relatively thick wall may be prevented from being insufficiently cooled. Thereby, a temperature gradient or thermal stress may be prevented from occurring in the turbine vane 520, and damage due to the temperature gradient or thermal stress may be avoided.

Although in the above-mentioned embodiment both the numbers of injection holes 712, 714, 722, 724, and 730 per unit area and the inner diameters of the injection holes 712, 714, 722, 724, and 730 are described as being different from each other, the difference may only be the numbers or the inner diameters.

For example, as shown in FIG. 5, the numbers of injection holes 712, 714, 722, 724, and 730 per unit area may differ from each other while the injection holes 712, 714, 722, 724, and 730 have the same inner diameter.

Alternatively, although not shown, the inner diameters of the injection holes 712, 714, 722, 724, and 730 may differ from each other while the numbers of injection holes 712, 714, 722, 724, and 730 per unit area are constant.

In the foregoing exemplary cases, the operation and effect thereof may be the same as those of the above-described embodiment.

However, in these exemplary cases, a process of manufacturing the impingement plate 700 including the injection holes 712, 714, 722, 724, and 730 may be facilitated because there is no need to take into account interrelation between the intervals and sizes of the injection holes 712, 714, 722, 724, and 730.

In the above-mentioned embodiment, there has been described the case where the numbers of injection holes 712, 714, 722, 724, and 730 per unit area differ from each other in such a way that the intervals between the injection holes 712, 714, 722, 724, and 730 differ from each other, but the numbers of injection holes 712, 714, 722, 724, and 730 per unit area may be differ from each other in other ways.

For example, as shown in FIG. 5, the injection holes 712, 714, 722, 724, and 730 may be formed such that the intervals therebetween differ from each other and, in addition, additional injection holes 712, 714, 722, 724, or 730 may be formed at positions which require a comparatively high injection rate of air. In other words, the downstream-side injection holes 714 may include a first downstream-side injection hole 714*a* which is formed at a position overlapping with the corresponding upstream-side injection hole 712 with respect to the flow direction (x-axis direction of FIG. 5) of air in the impingement space S, and a second downstream-side injection hole 714*b* which is formed at a position not overlapping with the upstream-side injection hole 712 with respect to the flow direction (x-axis direction of FIG. 5) of air in the impingement space S.

Alternatively, although not shown, the injection holes 712, 714, 722, 724, and 730 may be formed such that the intervals therebetween remain constant and, in addition, additional injection holes 712, 714, 722, 724, or 730 may be formed at positions which require a comparatively high injection rate of air.

In the foregoing exemplary cases, the operation and effect thereof may be the same as those of the above-described embodiment.

However, in these exemplary cases, the regions (positions) that require a comparatively high injection rate of air may be more effectively cooled.

In the embodiment shown in FIG. 5, the numbers of additional injection holes 712, 714, 722, 724, and 730 are increased from the upstream side to the downstream side with respect to the flow direction (x-axis direction of FIG. 5) of air in the impingement space S while there is no addition of injection holes 712, 714, 722, 724, and 730 from the center side to the end side with respect to the extension direction (z-axis direction of FIG. 5) of the turbine vane airfoil part 526.

However, the present disclosure is not limited to this embodiment, and, although not shown, injection holes 712, 714, 722, 724, and 730 may be added with respect to the extension direction (z-axis direction of FIG. 5) of the turbine vane airfoil part 526.

However, taking into account advantages and disadvantages resulting from the addition of the injection holes 712, 714, 722, 724, and 730, it may be preferable that, as shown in the embodiment of FIG. 5, additional injection holes 712, 714, 722, 724, and 730 be provided with respect to the flow direction (x-axis direction of FIG. 5) of air in the impingement space S.

In detail, the addition of the injection holes 712, 714, 722, 724, and 730 has a first advantage of enhancing the cooling performance due to an increase in the number of injection holes 712, 714, 722, 724, and 730 per unit area.

Furthermore, because the additional injection holes 712, 714, 722, 724, and 730 are not affected by the cross flow effect, there is a second advantage in that the cooling performance can be more effectively enhanced. That is, because the first downstream-side injection hole 714*a* is disposed on a flow path of air that is ejected from the upstream-side injection hole 712 and flows toward the exit hole E, air ejection of the first downstream-side injection hole 714*a* is impeded by the air ejected from the upstream-side injection hole 712. However, because the second downstream-side injection hole 714*b* is displaced from the flow path of air that is ejected from the upstream-side injection hole 712 and flows toward the exit hole E, so that air ejection of the second downstream-side injection hole 714*b* may not be impeded by the air ejected from the upstream-side injection hole 712. Consequently, under conditions of the same number of additional injection holes, the case where the second downstream-side injection hole 714*b* is added may be more effective in terms of enhancement of the cooling performance than the case where the first downstream-side injection hole 714*a* is added.

On the other hand, the addition of the injection holes 712, 714, 722, 724, and 730 is disadvantageous in that the production cost is increased.

Taking into account the above-mentioned advantages and disadvantages, as shown in the embodiment of FIG. 5, in the case where additional injection holes 712, 714, 722, 724, and 730 are provided with respect to the flow direction (x-axis direction of FIG. 5) of air in the impingement space S, the cost-to-benefit ratio may be increased because both the first advantage and the second advantage can be obtained although the production cost is increased.

However, in the case where the additional injection holes 712, 714, 722, 724, and 730 are provided with respect to the extension direction (z-axis direction of FIG. 5) of the turbine vane airfoil part 526, the production cost is increased, and only the first advantage may be obtained. Therefore, the cost-to-benefit ratio may be reduced.

Although the embodiment shown in FIG. 5 includes both the first downstream-side injection hole 714*a* and the second downstream-side injection hole 714*b*, only the second downstream-side injection hole 714*b* may be provided although not shown.

In other words, the upstream-side injection hole 712 and the downstream-side injection hole 714 may be formed such that they do not overlap with each other with respect to the flow direction of air in the impingement space S.

In this case, although the cooling performance is slightly reduced compared to that of the above-mentioned embodiment, the production cost may be reduced by a reduction in the number of injection holes 712, 714, 722, 724, and 730.

While the present disclosure has been described with respect to the specific embodiments, it will be apparent to those skilled in the art that various changes and modifications may be made without departing from the spirit and scope of the disclosure as defined in the following claims.

What is claimed is:

1. A gas turbine comprising:

a housing;

a rotor rotatably provided in the housing;

a turbine blade configured to receive rotating force from combustion gas and rotate the rotor;

a turbine vane configured to guide a flow of the combustion gas toward the turbine blade, the turbine vane having a leading edge, a trailing edge, and a turbine vane cooling passage for delivering cooling fluid to an inner wall of the turbine vane; and an impingement plate installed in the turbine vane cooling passage and spaced apart from the inner wall of the turbine vane so that an impingement space is defined between the impingement plate and the inner wall of the turbine vane, the impingement plate having a plurality of injection holes through which the cooling fluid is injected onto the inner wall of the turbine vane, the injection holes formed at predetermined locations of the impingement plate, wherein the impingement space communicates with each of a first exit hole formed in the leading edge and a second exit hole formed in the trailing edge, so that cooling fluid ejected from the injection holes into the impingement space drains from the impingement space through the first and second exit holes, respectively, after having impinged against the inner wall of the turbine vane, and wherein the injection holes comprise:

upstream-side injection holes disposed upstream with respect to a flow direction of the cooling fluid in the impingement space toward the first and second exit holes, respectively, the upstream-side injection holes including a first number of injection holes per unit area; and downstream-side injection holes disposed downstream with respect to the flow direction of the cooling fluid in the impingement space toward the first and second exit holes, respectively, the downstream-side injection holes including a second number of injection holes per unit area that is greater than the first number of injection holes per unit area.

2. The gas turbine according to claim 1, wherein an interval between the downstream-side injection holes is smaller than an interval between the upstream-side injection holes.

3. The gas turbine according to claim 1, wherein the downstream-side injection holes comprise:

a first downstream-side injection hole formed to overlap with the upstream-side injection hole with respect to the flow direction of the cooling fluid in the impingement space; and a second downstream-side injection hole formed not to overlap with the upstream-side injection hole with respect to the flow direction of the cooling fluid in the impingement space.

4. The gas turbine according to claim 1, wherein the injection holes are formed such that a number of injection holes per unit area is gradually increased from the upstream side to the downstream side with respect to the flow direction of the cooling fluid in the impingement space.

5. The gas turbine according to claim 1, wherein an inner diameter of each of the downstream-side injection hole is greater than an inner diameter of each of the upstream-side injection hole.

6. The gas turbine according to claim 5, wherein the injection holes are formed such that inner diameters of injection holes are gradually increased from the upstream side to the downstream side with respect to the flow direction of the cooling fluid in the impingement space.

7. The gas turbine according to claim 1, wherein the turbine vane comprises:

a turbine vane platform part formed in an annular shape along a rotation direction of the rotor; and a turbine vane airfoil part extending from the turbine vane platform part in a rotational radial direction of the rotor, wherein the impingement plate is configured to inject cooling fluid onto an inner wall of the turbine vane airfoil part, and wherein the injection holes comprise:

a center-side injection hole disposed at a center side with respect to an extension direction of the turbine vane airfoil part; and an end-side injection hole disposed at an end side with respect to the extension direction of the turbine vane airfoil part.

8. The gas turbine according to claim 7, wherein a number of end-side injection holes per unit area is greater than a number of center-side injection holes per unit area.

9. The gas turbine according to claim 8, wherein the injection holes are formed such that a number of injection holes per unit area is gradually increased from the center side to the end side with respect to the extension direction of the turbine vane airfoil part.

10. The gas turbine according to claim 7, wherein an inner diameter of each of the end-side injection hole is greater than an inner diameter of each of the center-side injection hole.

11. The gas turbine according to claim 10, wherein the injection holes are formed such that inner diameters of the injection holes are gradually increased from the center side to the end side with respect to the extension direction of the turbine vane airfoil part.

12. The gas turbine according to claim 7, wherein the turbine vane further comprises a turbine vane fillet part forming a boundary part between the turbine vane platform part and the turbine vane airfoil part, wherein the turbine vane fillet part is thicker than the turbine vane airfoil part, and wherein the impingement plate is configured to inject cooling fluid onto an inner wall of the turbine vane fillet part.

13. The gas turbine according to claim 12, wherein the injection holes comprise:

turbine-vane-airfoil-part-side injection holes disposed adjacent to the turbine vane airfoil part; and turbine-vane-fillet-part-side injection holes disposed adjacent to the turbine vane fillet part.

14. The gas turbine according to claim 13, wherein a number of turbine-vane-fillet-part-side injection holes per unit area is greater than a number of turbine-vane-airfoil-part-side injection holes per unit area.

15. The gas turbine according to claim 14, wherein the injection holes are formed such that a number of injection holes per unit area is gradually increased from the turbine vane airfoil part to the turbine vane fillet part.

16. The gas turbine according to claim 13, wherein an inner diameter of each of the turbine-vane-fillet-part-side injection holes is greater than an inner diameter of each of the turbine-vane-airfoil-part-side injection holes.

17. The gas turbine according to claim 16, wherein the injection holes are formed such that inner diameters of injection holes are gradually increased from the turbine vane airfoil part to the turbine vane fillet part.

* * * * *